US011557257B2

(12) United States Patent
Hwang et al.

(10) Patent No.: US 11,557,257 B2
(45) Date of Patent: Jan. 17, 2023

(54) DISPLAY DEVICE

(71) Applicant: Samsung Display Co., Ltd., Yongin-Si (KR)

(72) Inventors: Junghwan Hwang, Seongnam-si (KR); Yang-Hwa Choi, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/572,938

(22) Filed: Jan. 11, 2022

(65) Prior Publication Data

US 2022/0335898 A1 Oct. 20, 2022

(30) Foreign Application Priority Data

Apr. 19, 2021 (KR) ..... 10-2021-0050531

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/08* (2013.01); *G09G 2330/028* (2013.01)

(58) Field of Classification Search
None
See application file for complete search history.

(56) References Cited

U.S. PATENT DOCUMENTS

2016/0124491 A1* 5/2016 An ..... G06F 1/3265 713/323
2020/0219450 A1* 7/2020 Lee ..... G09G 3/3275
2020/0226978 A1* 7/2020 Lin ..... G09G 3/3258
2020/0394962 A1 12/2020 Seo et al.
2021/0056895 A1* 2/2021 Lee ..... G09G 3/3233

FOREIGN PATENT DOCUMENTS

KR 1020190046346 A 5/2019
KR 1020200142160 A 12/2020

* cited by examiner

*Primary Examiner* — Sepehr Azari
(74) *Attorney, Agent, or Firm* — Cantor Colburn LLP

(57) ABSTRACT

A pixel includes a first transistor, a second transistor, a third transistor, a capacitor, and a light emitting diode. During a non-emission period of a low frequency mode, the third transistor electrically connects a first terminal of the light emitting diode to an initialization voltage line in response to a second scan signal. An initialization voltage transferred from the initialization voltage line has a first voltage level during a normal mode different from the low frequency mode, and has a second voltage level different from the first voltage level during the non-emission period of the low frequency mode.

15 Claims, 11 Drawing Sheets

DISPLAY DEVICE

This application claims priority to Korean Patent Application No. 10-2021-0050531, filed on Apr. 19, 2021, and all the benefits accruing therefrom under 35 U.S.C. § 119, the content of which in its entirety is herein incorporated by reference.

BACKGROUND

Embodiments of the present disclosure described herein relate to a display device.

Among display devices, an organic light emitting display device displays an image by using an organic light emitting diode that generates light by recombination of electrons and holes. Such an organic light emitting display device has an advantage of having a fast response speed and being driven with low power consumption.

The organic light emitting display device includes pixels connected to data lines and scan lines. The pixels generally include the organic light emitting diode and a circuit unit for controlling an amount of current flowing through the organic light emitting diode. The circuit unit controls the amount of current flowing from the first driving voltage to the second driving voltage via the organic light emitting diode in response to a data signal. In this case, light of a predetermined luminance corresponding to the amount of current flowing through the organic light emitting diode is generated.

SUMMARY

Embodiments of the present disclosure provide a display device capable of preventing deterioration in display quality of an image even when a driving frequency is changed.

According to an embodiment of the present disclosure, a pixel includes: a first transistor including a first electrode which receives a first driving voltage, a second electrode, and a gate electrode; a second transistor including a first electrode which receives a data signal, a second electrode connected to the gate electrode of the first transistor, and a gate electrode which receives a first scan signal; a third transistor including a first electrode connected to an initialization voltage line, a second electrode connected to the second electrode of the first transistor, and a gate electrode which receives a second scan signal; a capacitor connected between the gate electrode and the second electrode of the first transistor; and a light emitting diode including a first terminal connected to the second electrode of the first transistor and a second terminal which receives a second driving voltage. During a non-emission period of a low frequency mode, the third transistor electrically connects the first terminal of the light emitting diode to the initialization voltage line in response to the second scan signal, and an initialization voltage transferred from the initialization voltage line has a first voltage level during a normal mode different from the low frequency mode, and has a second voltage level different from the first voltage level during the non-emission period of the low frequency mode.

According to an embodiment, the second scan signal may swing between a high voltage and a low voltage during the normal mode, and the second scan signal may have an intermediate voltage between the high voltage and the low voltage during the non-emission period of the low frequency mode.

According to an embodiment, when the second scan signal has the intermediate voltage, the third transistor may electrically connect the first terminal of the light emitting diode to the initialization voltage line.

According to an embodiment, the second voltage level of the initialization voltage may be less than the first voltage level.

According to an embodiment, the intermediate voltage of the second scan signal may be greater than the second voltage level of the initialization voltage.

According to an embodiment, each of the first transistor, the second transistor, and the third transistor may be an N-type transistor.

According to an embodiment of the present disclosure, a display device includes: a pixel, a voltage generator which provides an initialization voltage of a first voltage level to the pixel and generates a low voltage of a third voltage level; a scan driving circuit which provides a first scan signal and a second scan signal to the pixel, where the first scan signal and the second scan signal swing between a high level voltage and a low level voltage; a data driving circuit which outputs a data signal to the pixel, and a driving controller which controls the scan driving circuit, the data driving circuit, and the voltage generator. The voltage generator changes the initialization voltage to a second voltage level different from the first voltage level during a non-emission period of a low frequency mode, and changes the low voltage to a fourth voltage level different from the third voltage level.

According to an embodiment, an operation mode of the display device may include a normal mode operating at a first driving frequency and the low frequency mode operating at a second driving frequency lower than the first driving frequency, a low frequency frame of the low frequency mode may include a driving period and at least one non-driving period, and the non-emission period may be a part of the non-driving period.

According to an embodiment, the driving controller may output a voltage control signal corresponding to the operation mode, and the voltage generator may generate the initialization voltage and the low voltage in response to the voltage control signal.

According to an embodiment, in each of the normal mode and the driving period, the first scan signal and the second scan signal may swing between the high level voltage and the low voltage of the third voltage level.

According to an embodiment, during the non-emission period of the non-driving period, the first scan signal and the second scan signal may be maintained at the low voltage of the fourth voltage level, and during the non-driving period except for the non-emission period, the first scan signal and the second scan signal may be maintained at the low voltage of the third voltage level.

According to an embodiment, the pixel may include: a first transistor including a first electrode which receives a first driving voltage, a second electrode, and a gate electrode; a second transistor including a first electrode which receives the data signal, a second electrode connected to the gate electrode of the first transistor, and a gate electrode which receives the first scan signal; a third transistor including a first electrode which receives the initialization voltage, a second electrode connected to the second electrode of the first transistor, and a gate electrode which receives the second scan signal; a capacitor connected between the gate electrode and the second electrode of the first transistor; and a light emitting diode including a first terminal connected to the second electrode of the first transistor and a second terminal which receives a second driving voltage.

According to an embodiment, each of the first transistor, the second transistor, and the third transistor may be an N-type transistor.

According to an embodiment, the fourth voltage level of the low voltage may be greater than the second voltage level of the initialization voltage.

According to an embodiment, the voltage generator may further generate the first driving voltage and the second driving voltage.

BRIEF DESCRIPTION OF THE FIGURES

The above and other features of the present disclosure will become apparent by describing in detail embodiments thereof with reference to the accompanying drawings.

DETAILED DESCRIPTION

Figure 1:
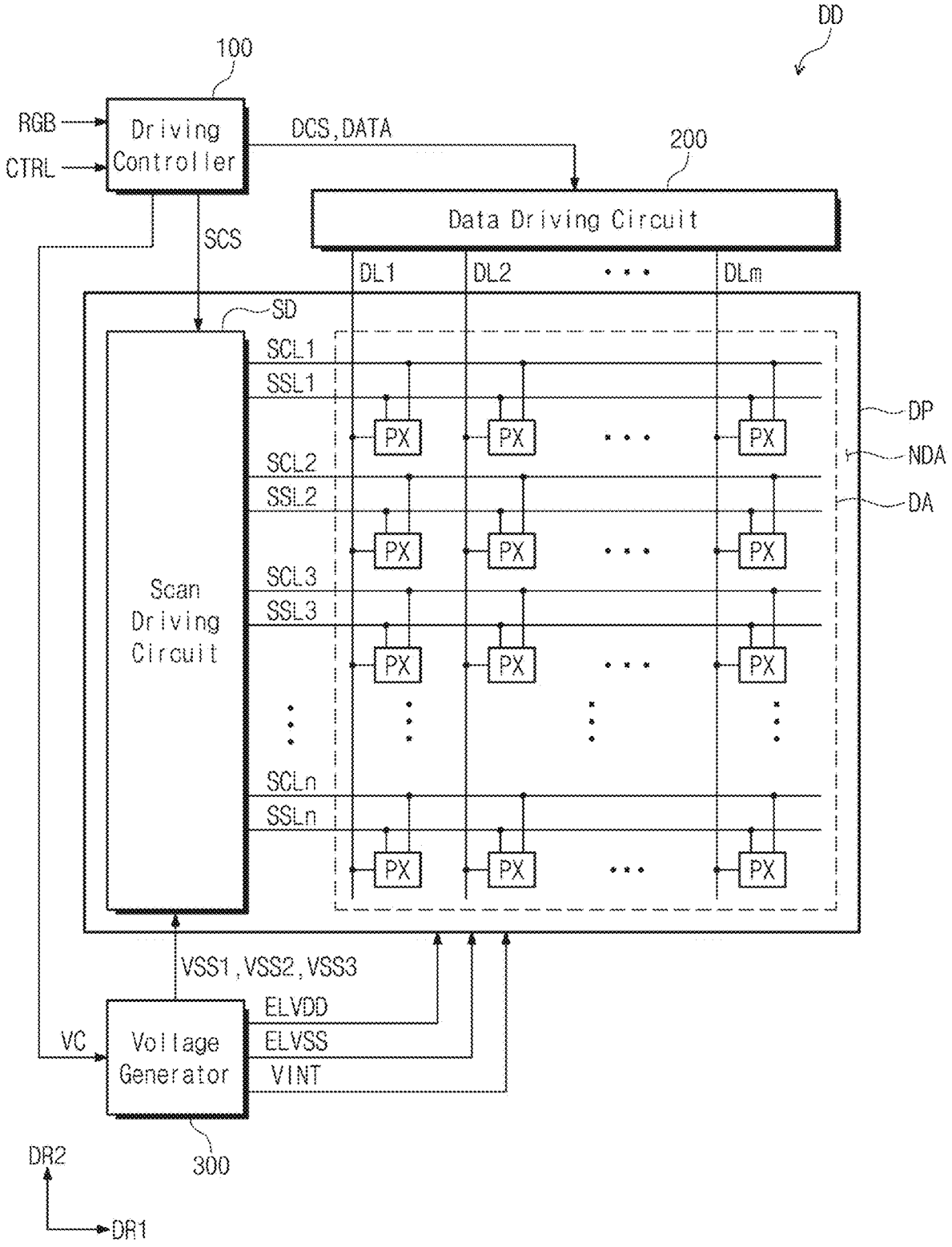
FIG. 1 is a block diagram of a display device according to an embodiment of the present disclosure.

In the specification, when one component (or area, layer, part, or the like) is referred to as being "on", "connected to", or "coupled to" another component, it should be understood that the former may be directly on, connected to, or coupled to the latter, and also may be on, connected to, or coupled to the latter via a third intervening component.

Like reference numerals refer to like components. Also, in drawings, the thickness, ratio, and dimension of components are exaggerated for effectiveness of description of technical contents. The term "and/or" includes one or more combinations of the associated listed items.

The terms" "first", "second", etc. are used to describe various components, but the components are not limited by the terms. The terms are used only to differentiate one component from another component. For example, a first component may be named as a second component, and vice versa, without departing from the spirit or scope of the present disclosure. A singular form, unless otherwise stated, includes a plural form.

Also, the terms "under", "beneath", "on", "above" are used to describe a relationship between components illustrated in a drawing. The terms are relative and are described with reference to a direction indicated in the drawing.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be understood that the terms "include", "comprise", "have", etc. specify the presence of features, numbers, steps, operations, elements, or components, described in the specification, or a combination thereof, not precluding the presence or additional possibility of one or more other features, numbers, steps, operations, elements, or components or a combination thereof.

Unless defined otherwise, all terms (including technical and scientific terms) used herein have the same meaning as commonly understood by one of ordinary skill in the art to which this disclosure belongs. In addition, terms such as terms defined in commonly used dictionaries should be interpreted as having a meaning consistent with the meaning in the context of the related technology, and should not be interpreted as an ideal or excessively formal meaning unless explicitly defined in the present disclosure.

Hereinafter, embodiments of the present disclosure will be described with reference to accompanying drawings.

FIG. 1 is a block diagram of a display device according to an embodiment of the present disclosure.

Referring to FIG. 1, a display device DD includes a display panel DP, a driving controller 100, a data driving circuit 200, and a voltage generator 300.

The driving controller 100 receives an image signal RGB and a control signal CTRL. The driving controller 100 generates an image data signal DATA obtained by converting a data format of the image signal RGB to meet a specification of an interface with the data driving circuit 200. The driving controller 100 outputs a scan control signal SCS and a data control signal DCS. In this embodiment, the driving controller 100 may output a voltage control signal VC corresponding to an operation mode.

The data driving circuit 200 receives the data control signal DCS and the image data signal DATA from the driving controller 100. The data driving circuit 200 converts the image data signal DATA into data signals (See Di in FIG. 4), and outputs the data signals to a plurality of data lines DL1 to DLm, which will be described later. The data signals are analog voltages corresponding to gray scale values of the image data signal DATA.

The display panel DP includes first scan lines SCL1 to SCLn, second scan lines SSL1 to SSLn, the data lines DL1 to DLm, and pixels PX. The display panel DP may further include a scan driving circuit SD. In an embodiment, the scan driving circuit SD is disposed on a first side of the display panel DP. The first scan lines SCL1 to SCLn and the second scan lines SSL1 to SSLn extend from the scan driving circuit SD along a first direction DR1.

The display panel DP may be divided into a display area DA and a non-display area NDA. The pixels PX may be disposed in the display area DA, and the scan driving circuit SD may be disposed in the non-display area NDA.

The first scan lines SCL1 to SCLn and the second scan lines SSL1 to SSLn are arranged to be spaced apart from one another along a second direction DR2 crossing the first direction DR1. The data lines DL1 to DLm extend in a direction opposite to the second direction DR2 from the data driving circuit 200 and are arranged to be spaced apart from one another along the first direction DR1.

The plurality of pixels PX are electrically connected to the first scan lines SCL1 to SCLn, the second scan lines SSL1 to SSLn, and the data lines DL1 to DLm, respectively. For example, the pixels in a first row may be connected to the scan lines SCL1 and SSL1. Also, the pixels in a second row may be connected to the scan lines SCL2 and SSL2.

Each of the plurality of pixels PX includes a light emitting diode ED (refer to FIG. 4) and a pixel circuit PXC (refer to FIG. 4) that controls light emission of the light emitting diode ED. The pixel circuit PXC may include a plurality of transistors and a capacitor. The scan driving circuit SD may include transistors that are formed through the same process as the pixel circuit PXC.

Each of the plurality of pixels PX receives a first driving voltage ELVDD, a second driving voltage ELVSS, and an initialization voltage VINT.

The scan driving circuit SD receives the scan control signal SCS from the driving controller 100. The scan driving circuit SD may output first scan signals to the first scan lines SCL1 to SCLn, and may output second scan signals to the second scan lines SSL1 to SSLn, in response to the scan control signal SCS. The circuit configuration and operation of the scan driving circuit SD will be described in detail later.

In an embodiment, the scan driving circuit SD is disposed on the first side of the display area DA, but the present disclosure is not limited thereto. In another embodiment, two scan driving circuit SD may be disposed on the first side and the second side of the display area DA, respectively. For example, the scan driving circuit disposed on the first side of the display area DA may provide the first scan signals to the first scan lines SCL1 to SCLn, and the scan driving circuit disposed on the second side of the display area DA may provide the second scan signals to the second scan lines SSL1 to SSLn.

The voltage generator 300 generates voltages used for the operation of the display panel DP. In this embodiment, the voltage generator 300 generates the first driving voltage ELVDD, the second driving voltage ELVSS, and the initialization voltage VINT, which are used for the operation of the display panel DP. The voltage generator 300 generates a first low voltage VSS1, a second low voltage VSS2, and a third low voltage VSS3, which are used for the operation of the scan driving circuit SD. The voltage generator 300 may further generate various voltages used for the operations of the display panel DP and the scan driving circuit SD as well as the first driving voltage ELVDD, the second driving voltage ELVSS, the initialization voltage VINT, the first low voltage VSS1, the second low voltage VSS2, and the third low voltage VSS3.

In this embodiment, the voltage generator 300 may determine the voltage levels of the third low voltage VSS3 and the initialization voltage VINT in response to the voltage control signal VC from the driving controller 100.

The scan driving circuit SD receives the first low voltage VSS1, the second low voltage VSS2, and the third low voltage VSS3 from the voltage generator 300. The voltage level of each of the first scan signals and the second scan signals output from the scan driving circuit SD may correspond to one of the first low voltage VSS1, the second low voltage VSS2, and the third low voltage VSS3.

Figure 2:
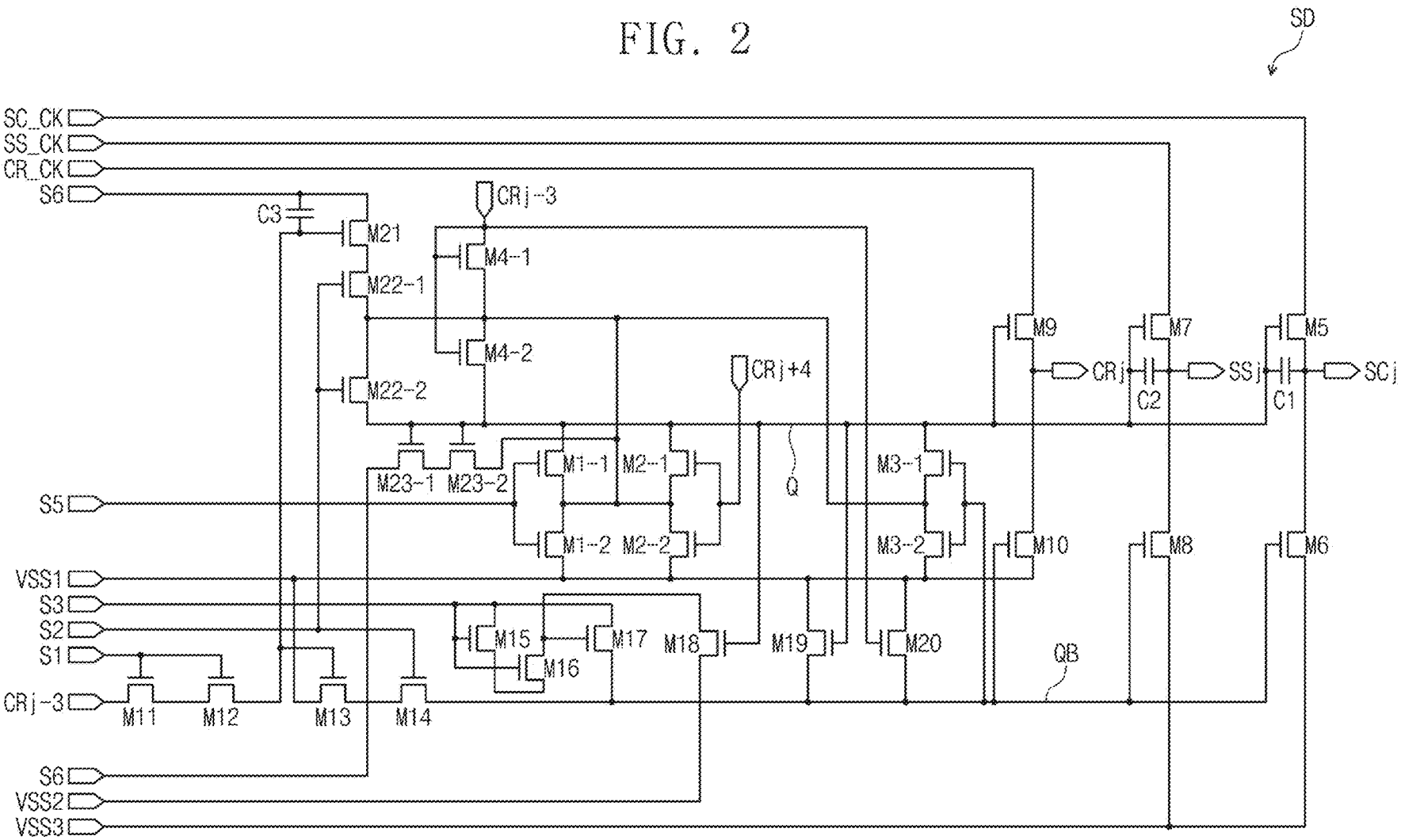
FIG. 2 is a circuit diagram illustrating a part of a scan driving circuit.
Figure 3:
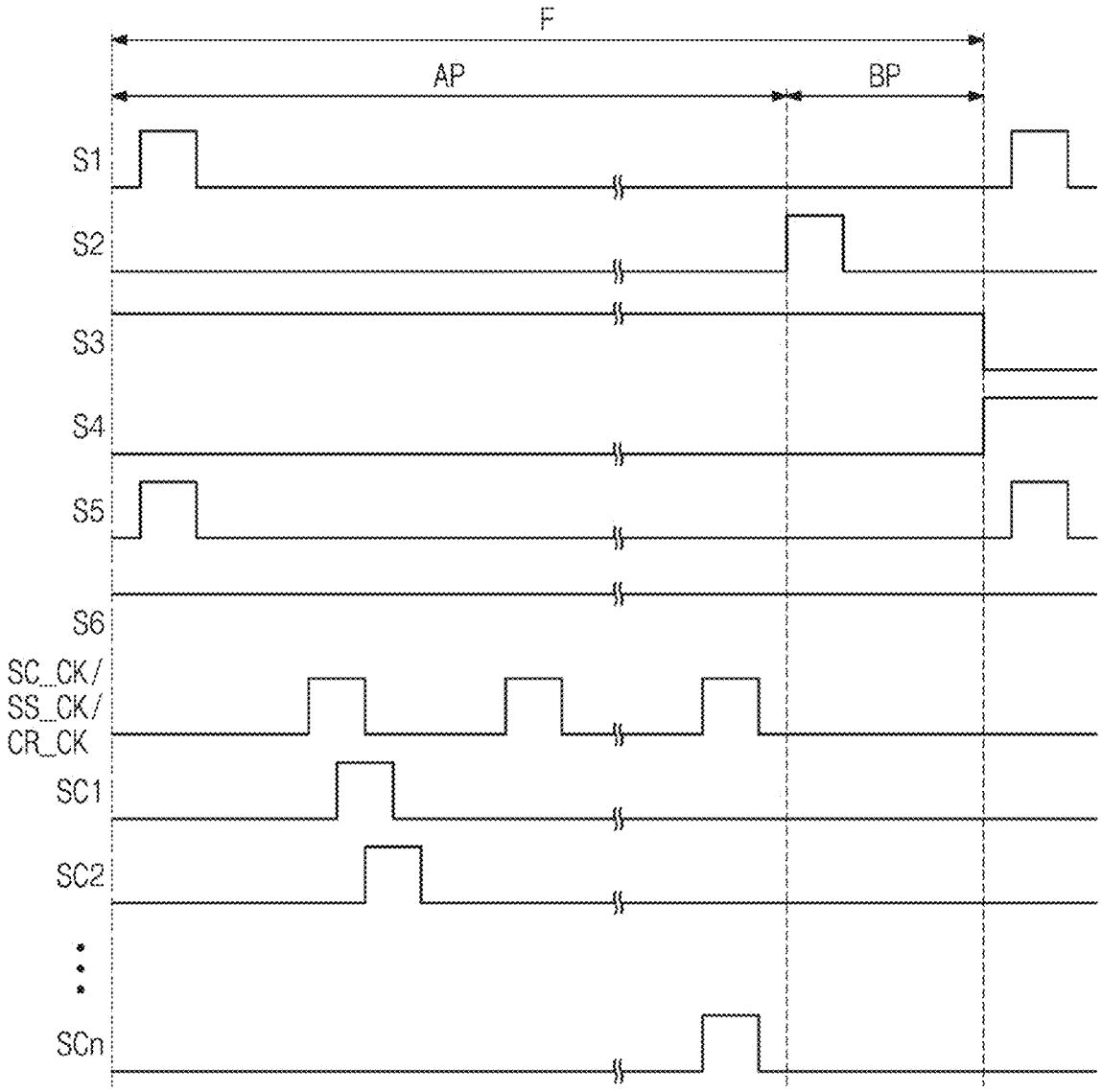
FIG. 3 is a timing diagram illustrating clock signals and switching signals provided to a scan driving circuit illustrated in FIG. 2.

FIG. 2 is a circuit diagram illustrating a part of a scan driving circuit. FIG. 3 is a timing diagram illustrating clock signals and switching signals provided to a scan driving circuit illustrated in FIG. 2.

FIG. 2 illustrates a part of the scan driving circuit SD that outputs a j-th first scan signal SCj and a j-th second scan signal SSj. In this case, the 'j' is a natural number from 1 to n. The scan driving circuit SD may include all circuit elements for outputting the first scan signals SC1 to SCn and the second scan signals SS1 to SSn.

The circuit illustrated in FIG. 2 is only an example of the scan driving circuit SD, and the circuit configuration of the scan driving circuit SD according to the invention may be variously changed.

Referring to FIGS. 2 and 3, the scan driving circuit SD may receive clock signals SC_CK, SS_CK, and CR_CK, switching signals S1 to S6, carry signals CRj−3 and CRj+4, the first low voltage VSS1, the second low voltage VSS2, and the third low voltage VSS3, and may output the first scan signal SCj, the second scan signal SSj, and a carry signal CRj. The carry signals CRj−3 and CRj+4 are signals generated inside the scan driving circuit SD. That is, the carry signal CRj−3 is a signal related to a j−3th first scan signal SCj−3 and a j−3th second scan signal SSj−3, and the carry signal CRj+4 may be a signal related to a j+4th first scan signal SCj+4 and a j+4th second scan signal SSj+4.

In one embodiment, some or all of the switching signals S1 to S6 may be provided from the driving controller 100 illustrated in FIG. 1. In one embodiment, some or all of the switching signals S1 to S6 may be provided by the voltage generator 300 illustrated in FIG. 1.

The scan driving circuit SD includes transistors M1-1, M1-2, M2-1, M2-2, M3-1, M3-2, M4-1, M4-2, M5 to M21, M22-1, M22-2, M23-1, and M23-2 and capacitors C1, C2, and C3.

The switching signals S1 and S5 transition to a high level at a start of one frame F, and then remain at a low level for the remainder of the one frame F. Each of the switching signals S1 and S5 may be a signal indicating the start of one frame. The one frame F may include an active period AP and a blank period BP.

The switching signal S2 is maintained at a low level (e.g., −9 V) during the active period AP, and transitions to a high level (e.g., 25 V) at the start of the blank period BP. The switching signal S2 may be a signal indicating the start of the blank period BP.

The switching signal S3 and the switching signal S4 are maintained at the high level (e.g., 25V) or the low level (e.g., −9V) for one frame. For example, in a k-th frame, the switching signal S3 is at the high level, and the switching signal S4 is at the low level. In the k+1th frame, the switching signal S3 is changed to the low level, and the switching signal S4 is changed to the high level. The switching signal S3 and the switching signal S4 may alternately transition to the high level and the low level in every frame.

The switching signal S6 is a signal maintained at the high level (e.g., 25V).

The scan driving circuit SD illustrated in FIG. 2 operates as follows.

When the switching signal S5 transitions from the start of the one frame F to the high level, the transistors M1-1 and M1-2 are turned on, and a first node Q is initialized to the first low voltage VSS1.

Since transistors M15 to M17 are turned on while the switching signal S3 is at the high level (e.g., 25V), a second node QB may be set to a high level corresponding to the switching signal S3.

When the carry signal CRj−3 transitions to the high level, the transistors M4-1 and M4-2 are turned on, and the first node Q may transition to the high level. When the clock signals SC_CK, SS_CK, and CR_CK are at the high level when the first node Q transitions to the high level, transistors M5, M7, and M9 are turned on and the first scan signal SCj, the second scan signal SSj, and the carry signal CRj may each transition to the high level. In addition, when the carry signal CRj−3 transitions to the high level, the transistor M20 is turned on and the second node QB is discharged to the first low voltage VSS1.

On the other hand, since the transistor M19 is turned on while the first node Q is at the high level, the second node QB may be maintained at the first low voltage VSS1, that is, the low level. Therefore, transistors M6, M8, and M10 may be maintained in a turned-off state.

When the clock signals SC_CK, SS_CK, and CR_CK each change from a high level to a low level, each of the first scan signal SCj, the second scan signal SSj, and the carry signal CRj transitions from the high level to the low level.

Subsequently, when the carry signal CRj+4 transitions to the high level, the transistors M2-1 and M2-2 are turned on, and the first node Q may be discharged to the first low voltage VSS1.

When the first node Q is at the first low voltage VSS1 and the carry signal CRj−3 is at the low level, the transistors M19 and M20 are turned off, and the second node QB may be maintained at a high level corresponding to the third switching signal S3. When the second node QB is at the high level, since the transistors M6, M8, and M10 are turned on, the first scan signal SCj, the second scan signal SSj, and the carry signal CRj may be maintained at the voltage level of the third low voltage VSS3. That is, in the blank period BP within the one frame F, the first scan signal SCj, the second scan signal SSj, and the carry signal CRj may be maintained at the third low voltage VSS3.

As illustrated in FIG. 3, the first scan signals SC1 to SCn may be sequentially activated to the high level during the active period AP. Although not illustrated in the drawing, the second scan signals SS1 to SSn may be sequentially activated to the high level during the active period AP, similar to the first scan signals SC1 to SCn.

Figure 4:
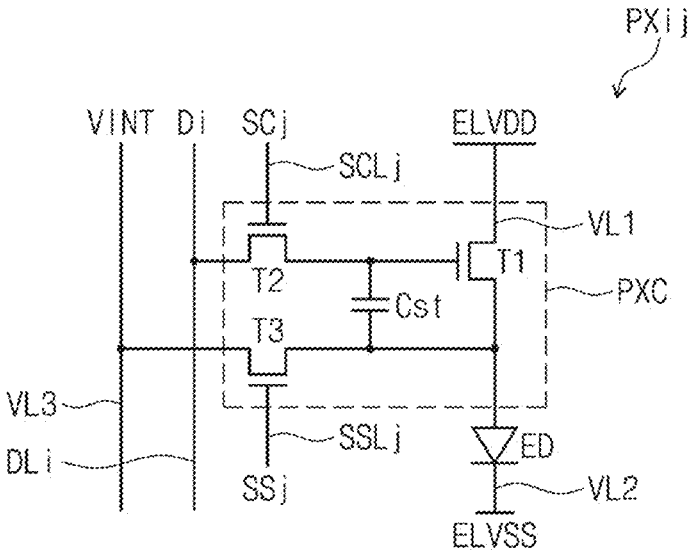
FIG. 4 is an equivalent circuit diagram of a pixel according to an embodiment of the present disclosure.

FIG. 4 is an equivalent circuit diagram of a pixel according to an embodiment of the present disclosure.

FIG. 4 illustrates an equivalent circuit diagram of a pixel PXij connected to the i-th data line DLi among the data lines DL1 to DLm, a j-th first scan line SCLj among the first scan lines SCL1 to SCLn, a j-th second scan line SSLj among the second scan lines SSL2 to SSLn, as illustrated in FIG. 1.

Each of the plurality of pixels PX illustrated in FIG. 1 may have the same circuit configuration as the equivalent circuit diagram of the pixel PXij illustrated in FIG. 4. In this embodiment, the pixel PXij includes at least one light emitting diode ED and a pixel circuit PXC.

In this embodiment, the pixel circuit PXC of the pixel PXij includes a first transistor T1, a second transistor T2, a third transistor T3, and a capacitor Cst. Each of the first to third transistors T1 to T3 may be an N-type transistor having an oxide semiconductor as a semiconductor layer. However, the present disclosure is not limited thereto, and each of the first to third transistors T1 to T3 may be a P-type transistor having a low-temperature polycrystalline silicon ("LTPS") semiconductor layer in another embodiment. In an embodiment, at least one of the first to third transistors T1 to T3 may be an N-type transistor, and the other may be a P-type transistor. Further, the circuit configuration of the pixel according to the present disclosure is not limited to FIG. 4. The pixel circuit PXC illustrated in FIG. 4 is only an example, and the configuration of the pixel circuit PXC may be modified and implemented.

Referring to FIG. 4, the first scan line SCLj may transfer the first scan signal SCj, and the second scan line SSLj may transfer the second scan signal SSj. A data line DLi transfers a data signal Di. The data signal Di may have a voltage level corresponding to the image signal RGB input to the display device DD (refer to FIG. 1).

The display panel DP illustrated in FIG. 1 may include first to third voltage lines VL1, VL2, and VL3. The first voltage line VL1 and the third voltage line VL3 may transfer the first driving voltage ELVDD and the initialization voltage VINT to the pixel circuit PXC, respectively, and the second voltage line VL2 may transfer the second driving voltage ELVSS to a cathode (or a second terminal) of the light emitting diode ED. The third voltage line VL3 may be an initialization voltage line that transfers the initialization voltage VINT to the pixel circuit PXC.

The first transistor T1 includes a first electrode (or a drain electrode) connected to the first voltage line VL1, and a second electrode (or a source electrode) electrically connected to an anode (or a first terminal) of the light emitting diode ED, and a gate electrode connected to one end of the capacitor Cst. The first transistor T1 may supply a driving current to the light emitting diode ED in response to the data signal Di transferred by the data line DLi depending on the switching operation of the second transistor T2.

The second transistor T2 includes a first electrode connected to the data line DLi, a second electrode connected to the gate electrode of the first transistor T1, and a gate electrode connected to the first scan line SCLj. The second transistor T2 is turned on depending on the first scan signal SCj transferred through the first scan line SCLj, and may transfer the data signal Di received from the data line DLi to the gate electrode of the first transistor T1.

The third transistor T3 includes a first electrode connected to the third voltage line VL3, a second electrode connected to the anode of the light emitting diode ED, and a gate electrode connected to the second scan line SSLj. The third transistor T3 is turned on depending on the second scan signal SSj received through the second scan line SSLj, and may transfer the initialization voltage VINT to the anode of the light emitting diode ED.

As described above, one end of the capacitor Cst is connected to the gate electrode of the first transistor T1, and the other end of the capacitor Cst is connected to the second electrode of the first transistor T1. The structure of the pixel PXij according to the embodiment is not limited to the structure illustrated in FIG. 5, and the number of transistors, the number of capacitors, and connection relationships included in one pixel PXij may be variously modified in other embodiments.

The display device DD illustrated in FIGS. 1 to 4 may operate in a normal mode operating at a first driving frequency and a low frequency mode operating at a second driving frequency. In one embodiment, the second driving frequency is lower than the first driving frequency. The first driving frequency and the second driving frequency may be one of various frequencies. For example, the first driving frequency may be one of 240 Hz, 120 Hz, and 60 Hz. The second driving frequency may be a lower frequency than the first driving frequency. For example, when the first driving frequency is 240 Hz, the second driving frequency may be one of 120 Hz, 60 Hz, 48 Hz, 10 Hz, and 1 Hz. For example, when the first driving frequency is 60 Hz, the second driving frequency may be one of 48 Hz, 10 Hz, and 1 Hz. In the following description, a case where the first driving frequency is 240 Hz and the second driving frequency is 48 Hz is described as an example, but the present disclosure is not limited thereto.

Figure 5:
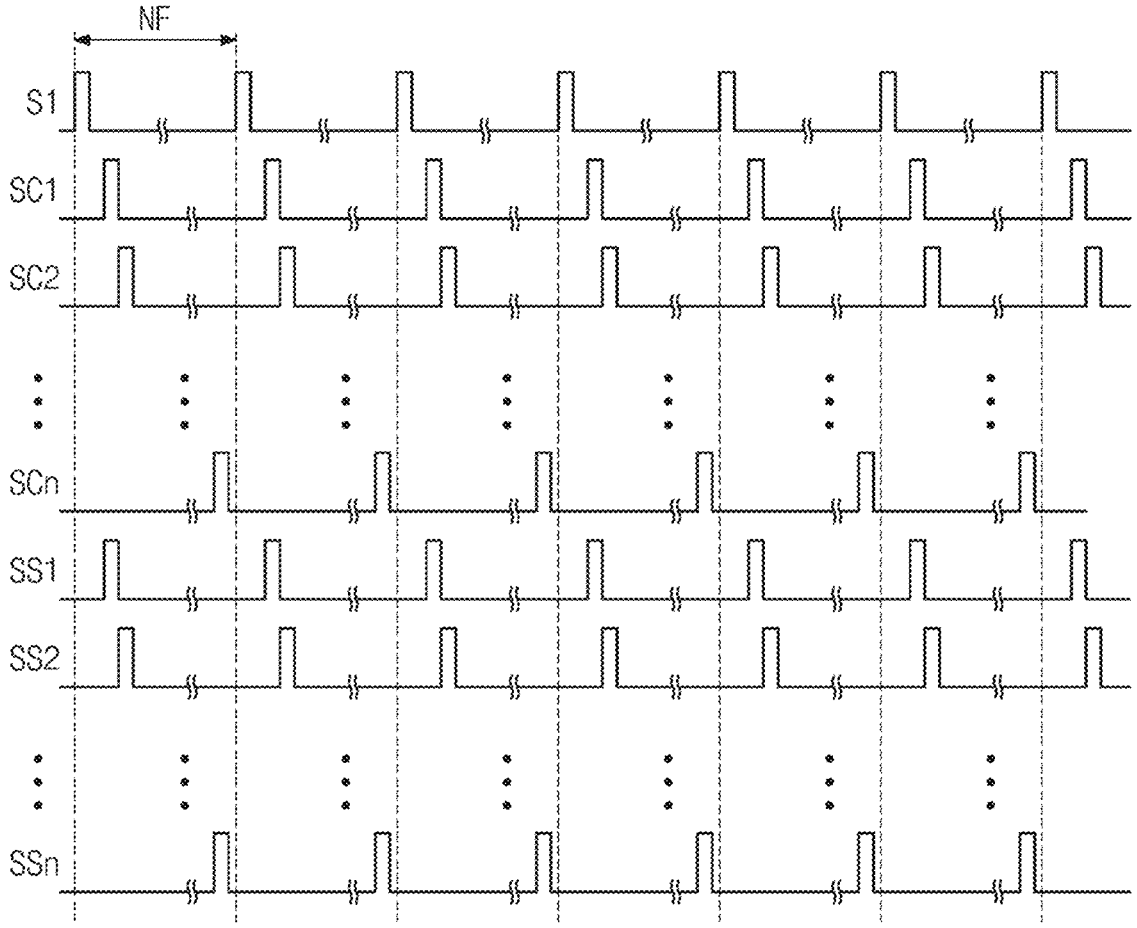
FIG. 5 is a diagram illustrating a switching signal, first scan signals, and second scan signals in a normal mode.

FIG. 5 is a diagram illustrating a switching signal, first scan signals, and second scan signals in a normal mode.

The switching signal S1 illustrated in FIG. 5 may be a signal indicating the start of one frame. In an embodiment, the switching signal S5 illustrated in FIG. 3 may be a signal indicating the start of one frame.

Referring to FIGS. 1, 4, and 5, the first scan signals SC1 to SCn sequentially transition to an active level of a high voltage during a normal frame NF in the normal mode. Also, during the normal frame NF, the second scan signals SS1 to SSn sequentially transition to the active level of the high voltage.

As illustrated in FIG. 4, when the second scan signal SSj transitions to the high voltage, the third transistor T3 is turned on and the initialization voltage VINT is transferred to the anode of the light emitting diode ED. The initialization voltage may be 2 voltages (V). The light emitting diode ED may be initialized with the initialization voltage VINT.

When the first scan signal SCj transitions to the high voltage, the second transistor T2 is turned on and the data signal Di is transferred to the gate electrode of the first transistor T1. The first transistor T1 is turned on by the data signal Di, and a driving current corresponding to a gate-source voltage of the first transistor T1 may be provided to the anode of the light emitting diode ED. In detail, the driving current corresponding to a difference between the data signal Di provided to the gate electrode of the first transistor T1 and the initialization voltage VINT may be provided to the anode of the light emitting diode ED.

The data signal Di and the initialization voltage VINT are provided at both ends of the capacitor Cst. Therefore, even though each of the first scan signal SCj and the second scan signal SSj transitions to the low level and the second transistor T2 and the third transistor T3 are turned off, since the gate-source voltage of the first transistor T1 is uniformly maintained, the driving current may be provided to the light emitting diode ED.

Figure 6:
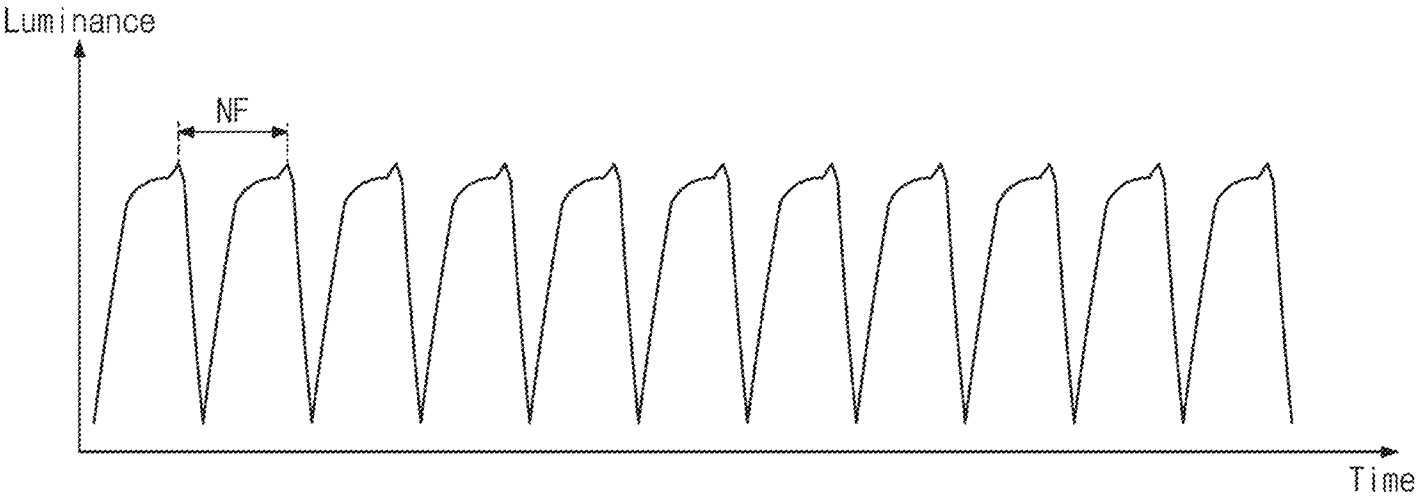
FIG. 6 is a diagram illustrating a change in luminance of a light emitting diode during a normal mode.

FIG. 6 is a diagram illustrating a change in luminance of a light emitting diode during a normal mode.

Referring to FIGS. 4, 5, and 6, it is assumed that the display device DD displays a predetermined image during the normal frame NF.

As the light emitting diode ED is initialized to the initialization voltage VINT and the driving current corresponding to the gate-source voltage of the first transistor T1 is provided to the light emitting diode ED during the normal frame NF, the luminance of the light emitting diode ED may change into a uniform curved shape every frame as shown in FIG. 6.

Figure 7:
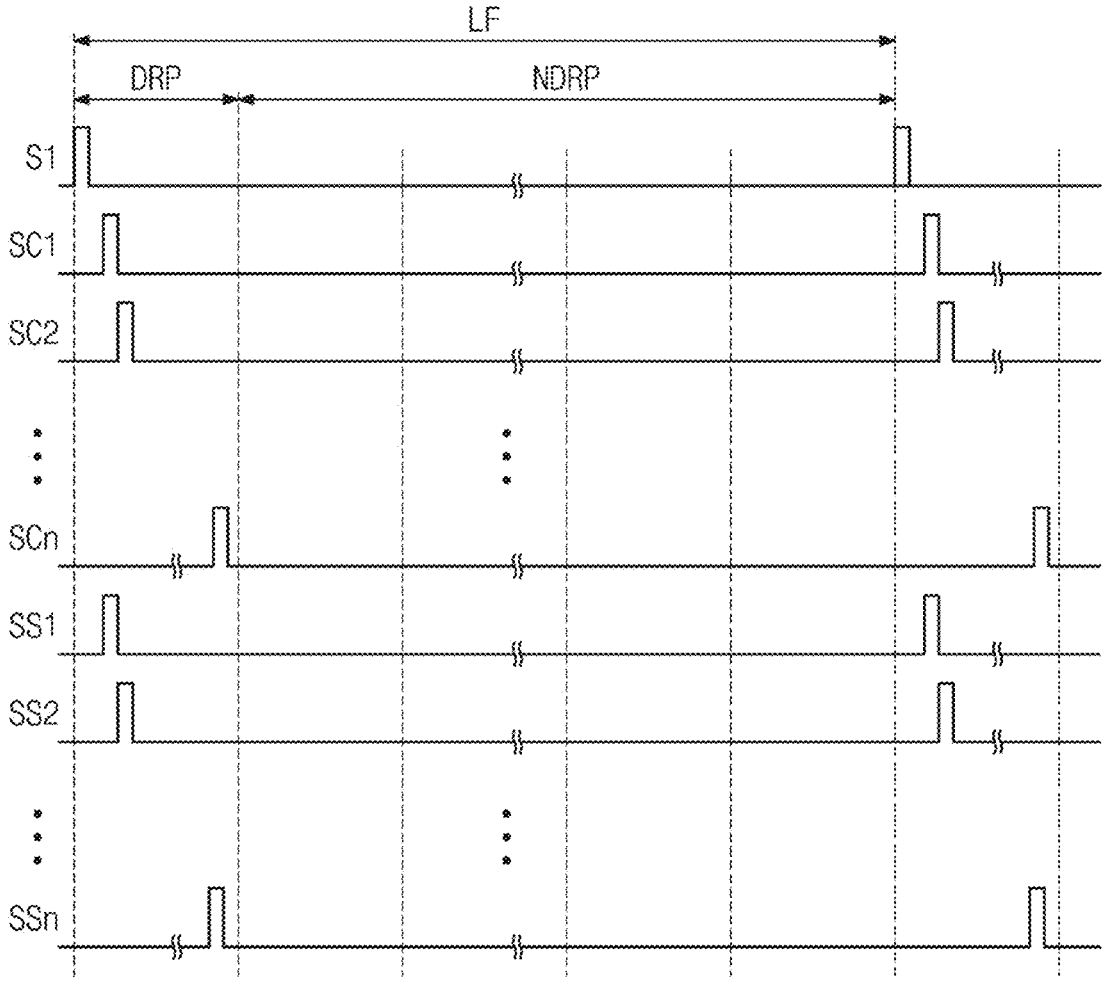
FIG. 7 is a diagram illustrating a switching signal, first scan signals, and second scan signals in a low frequency mode.

FIG. 7 is a diagram illustrating a switching signal, first scan signals, and second scan signals in a low frequency mode. The switching signal S1 may be a signal indicating the start of one frame. In an embodiment, the switching signal S5 illustrated in FIG. 3 may be a signal indicating the start of one frame.

Referring to FIGS. 1, 4, and 7, a low frequency frame LF in the low frequency mode includes a driving period DRP and a non-driving period NDRP. The driving period DRP of the low frequency frame LF may correspond to the normal frame NF illustrated in FIG. 5.

During the driving period DRP of the low frequency frame LF, the first scan signals SC1 to SCn sequentially transition to the active level of the high voltage. Also, during the driving period DRP of the low frequency frame LF, the second scan signals SS1 to SSn sequentially transition to the active level of the high voltage.

During the non-driving period NDRP of the low frequency frame LF, the first scan signals SC1 to SCn and the second scan signals SS1 to SSn may be maintained at an inactive level of the low level.

The driving period DRP of the low frequency frame LF may be a period in which the second and third transistors T2 and T3 are driven by the first scan signals SC1 to SCn and the second scan signals SS1 to SSn. The non-driving period NDRP of the low frequency frame LF may be a period in which the second and third transistors T2 and T3 are not driven by the first scan signals SC1 to SCn of the low level and the second scan signals SS1 to SSn of the low level.

Figure 8:
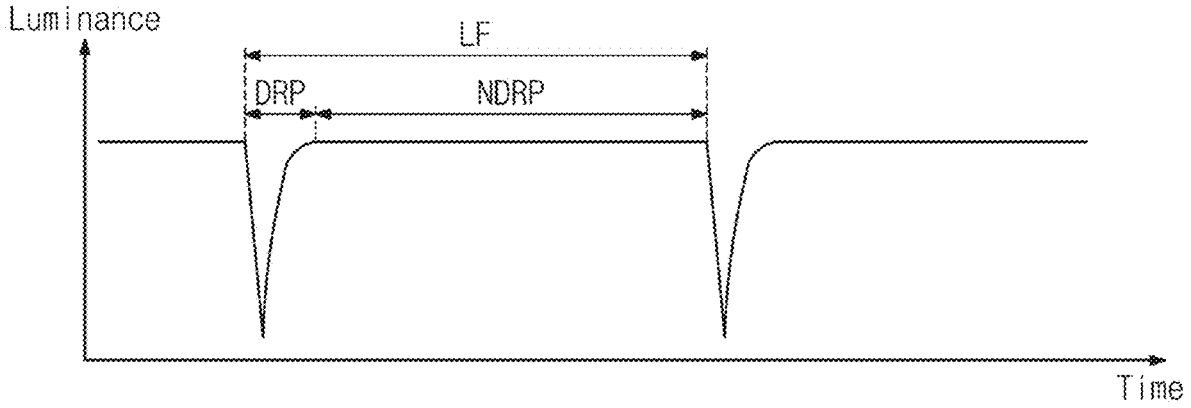
FIG. 8 is a diagram illustrating a change in luminance of a light emitting diode during a low frequency mode.

FIG. 8 is a diagram illustrating a change in luminance of a light emitting diode during a low frequency mode.

Referring to FIGS. 4, 7 and 8, the luminance of the light emitting diode ED during the driving period DRP of the low frequency frame LF may be the same as the luminance of the normal frame NF illustrated in FIG. 6.

When the first scan signal SC1 is at the low level and the second scan signal SS1 is at the low level during the non-driving period NDRP of the low frequency frame LF, the second transistor T2 and the third transistor T3 maintain the turned-off state.

In this case, since the gate-source voltage of the first transistor T1 may be maintained at a uniform level by the capacitor Cst connected between the gate electrode and the second electrode of the first transistor T1, the luminance of the light emitting diode ED may be maintained at a uniform level during the non-driving period NDRP.

The display device DD may include a frequency variable function called a variable refresh rate ("VRR"). In detail, the display device DD having the VRR function may change the operation mode to the normal mode and the low frequency mode at any time.

For example, while the display device DD displays a predetermined image, when the operation mode is frequently changed from the normal mode to the low frequency mode and from the low frequency mode to the normal mode, the luminance of the light emitting diode ED may be alternately changed into a shape of the luminance curve illustrated in FIG. 6 and a shape of the luminance curve illustrated in FIG. 8. In this case, a user may detect a difference between the luminance of the normal mode and the luminance of the low frequency mode as a flicker.

Figure 9:
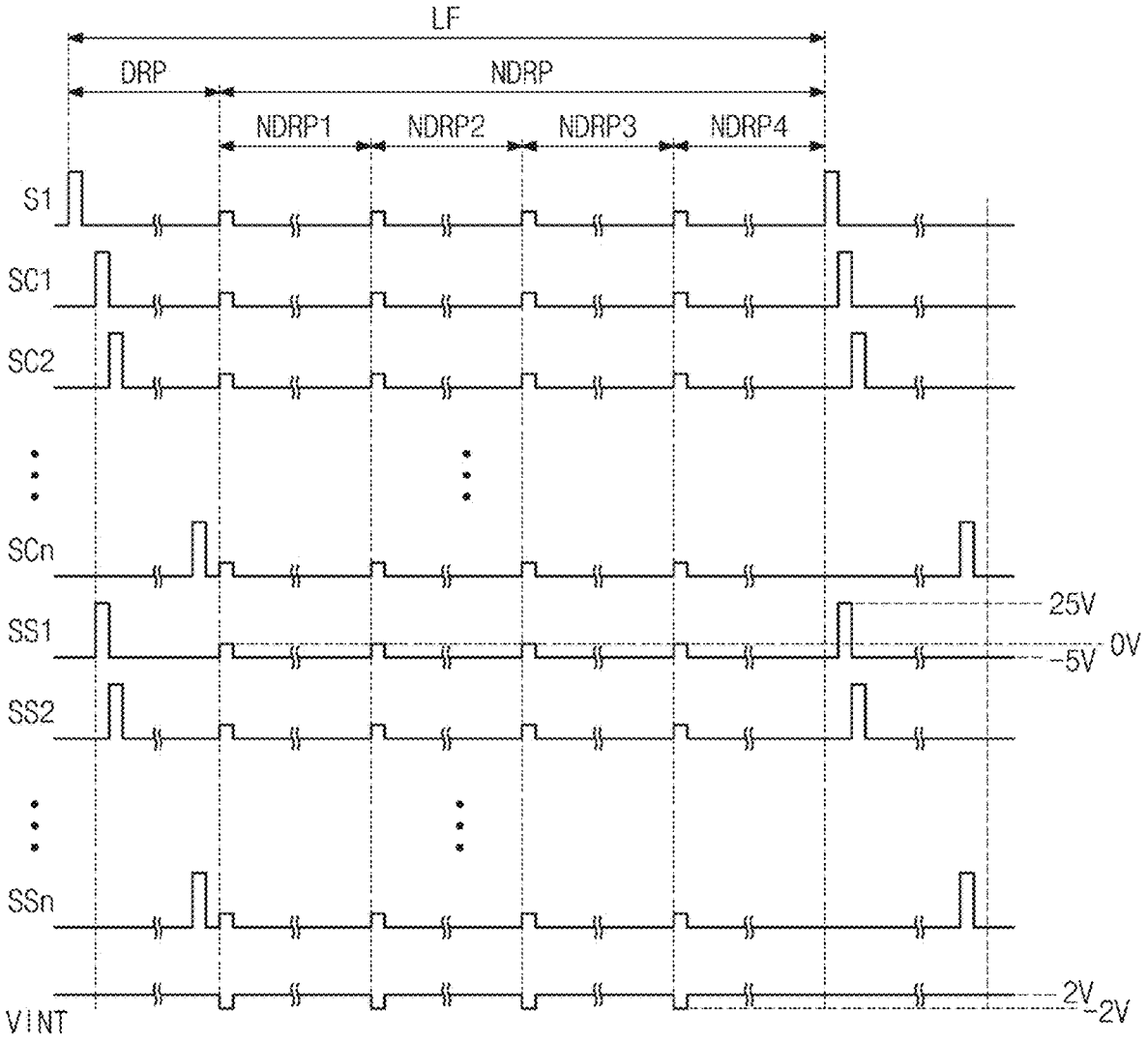
FIG. 9 is a diagram illustrating a switching signal, first scan signals, and second scan signals in a low frequency mode.

FIG. 9 is a diagram illustrating a switching signal, first scan signals, and second scan signals in a low frequency mode.

Referring to FIGS. 1, 4, and 9, the low frequency frame LF in the low frequency mode includes the driving period DRP and the non-driving period NDRP. The driving period DRP in the low frequency frame LF may correspond to the normal frame NF illustrated in FIG. 5.

During the driving period DRP in the low frequency frame LF, the first scan signals SC1 to SCn sequentially transition to the active level of the high voltage. In addition, during the driving period DRP in the low frequency frame LF, the second scan signals SS1 to SSn sequentially transition to the active level of the high voltage.

The non-driving period NDRP of the low frequency frame LF includes first to fourth non-driving periods NDRP1 to NDRP4. A duration of each of the first to fourth non-driving periods NDRP1 to NDRP4 may be the same as the driving period DRP.

At a start time of each of the first to fourth non-driving periods NDRP1 to NDRP4, the first scan signals SC1 to SCn and the second scan signals SS1 to SSn rise to an intermediate voltage and then change to a low voltage.

The intermediate voltage may be a voltage level between the high voltage and the low voltage of the first scan signals SC1 to SCn and the second scan signals SS1 to SSn. For example, when the high voltage of each of the first scan signals SC1 to SCn and the second scan signals SS1 to SSn is 25 V and the low voltage is −5 V, respectively, the intermediate voltage may be 0 V.

The initialization voltage VINT has a first voltage level V1 (e.g., 2 V) during the driving period DRP. The initialization voltage VINT is changed to a second voltage level (e.g., −2 V) lower than the first voltage level at the start time of each of the first to fourth non-driving periods NDRP1 to NDRP4 and then returns to the first voltage level during the remaining time of each of the first to fourth non-driving periods NDRP1 to NDRP4.

Figure 10:
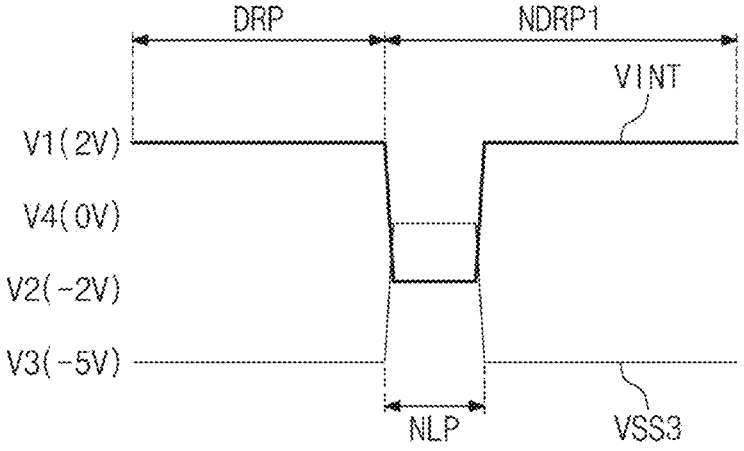
FIG. 10 is a diagram illustrating changes in an initialization voltage and a third low voltage during a driving period and a first non-driving period illustrated in FIG. 9.

FIG. 10 is a diagram illustrating changes in an initialization voltage and a third low voltage during a driving period and a first non-driving period illustrated in FIG. 9.

First, referring to FIGS. 2, 9, and 10, the clock signals SC_CK, SS_CK, and CR_CK are maintained at the low level in each of the first to fourth non-driving periods NDRP1 to NDRP4.

As illustrated in FIG. 3, the second node QB may be maintained at the high level by the switching signal S3 of the high level, and the transistors M6, M8, and M10 are turned on while the second node QB is at the high level. Therefore, in each of the first to fourth non-driving periods NDRP1 to NDRP4, the first scan signal SCj, the second scan signal SSj, and the carry signal CRj may be maintained at a low level corresponding to the voltage level of the third low voltage VSS3.

The voltage generator 300 illustrated in FIG. 1 may determine voltage levels of the third low voltage VSS3 and the initialization voltage VINT in response to the voltage control signal VC from the driving controller 100. During the driving period DRP, the voltage generator 300 sets the third low voltage VSS3 to a third voltage level V3 (e.g., −5 V), and sets the initialization voltage VINT to the first voltage level V1 (e.g., 2 V), in response to the voltage control signal VC. During the non-emission period NLP, at the start time of each of the first to fourth non-driving periods NDRP1 to NDRP4, the voltage generator 300 changes the third low voltage VSS3 to a fourth voltage level V4 (e.g., 0 V), and changes the initialization voltage VINT to a second voltage level V2 (e.g., −2 V), in response to the voltage control signal VC. The non-emission period NLP is a part of each of the first to fourth non-driving periods NDRP1 to NDRP4. In this embodiment, the non-emission period NLP may be a period for a predetermined time from the start time of each of the first to fourth non-driving periods NDRP1 to NDRP4.

In this embodiment, the first voltage level V1 and the second voltage level V2 of the initialization voltage VINT and the third voltage level V3 and the fourth voltage level V4 of the third low voltage VSS3 may have a relationship of V1>V4>V2>V3. In particular, the fourth voltage level V4 of the third low voltage VSS3 should be higher than the second voltage level V2 of the initialization voltage VINT.

Therefore, the first scan signals SC1 to SCn and the second scan signals SS1 to SSn output from the scan driving circuit SD rise to the intermediate voltage (e.g., 0 V, refer to FIG. 9), which is the fourth voltage level V4 during the non-emission period NLP.

Refer to FIG. 4, when the second scan signal SSj rises to 0 V, which is the fourth voltage level V4, since the initialization voltage VINT is −2 V, which is the second voltage level V2, the third transistor T3 is turned on and then the anode of the light emitting diode ED may be electrically connected to the third voltage line VL3. In this case, the current of the anode of the light emitting diode ED may be discharged to the third voltage line VL3. As a result, the anode of the light emitting diode ED is initialized, and the light emitting diode ED does not emit light.

The data signal Di has a voltage level of approximately 2 to 8 V. Therefore, even though the first scan signal SCj rises to 0 V, which is the fourth voltage level V4, there is no current discharge through the second transistor T2.

After the non-emission period NLP ends, the voltage generator 300 changes the third low voltage VSS3 to −5 V, which is the third voltage level V3, and changes the initialization voltage VINT to 2 V, which is the first voltage level V1. Accordingly, the third transistor T3 is turned off, and the first transistor T1 may be maintained in a turned-on state depending on a voltage difference between opposite ends of the capacitor Cst. As a result, the light emitting diode ED may display an image corresponding to the data signal Di in the driving period DRP.

Figure 11:
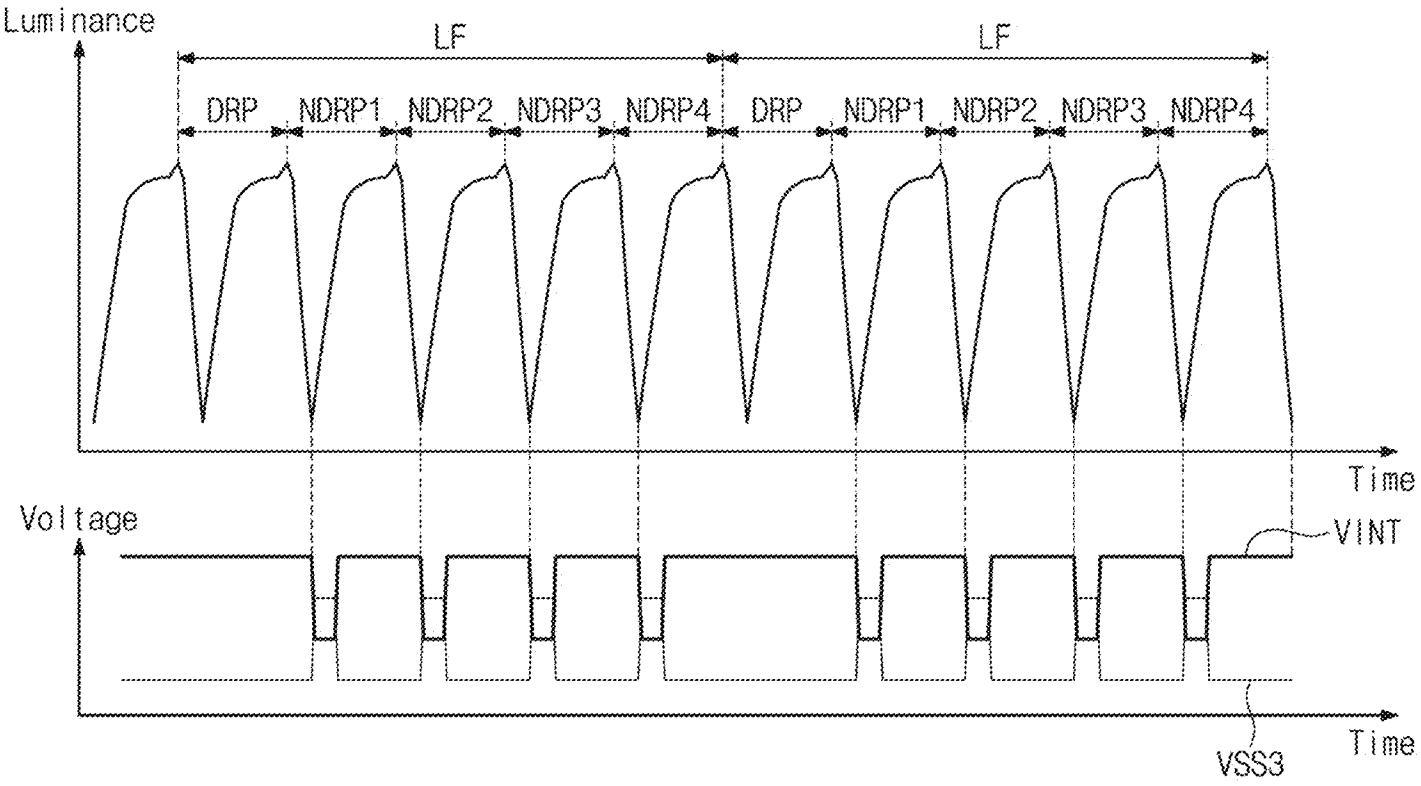
FIG. 11 is a diagram illustrating a change in luminance of a light emitting diode during a low frequency mode.

FIG. 11 is a diagram illustrating a change in luminance of a light emitting diode during a low frequency mode.

Referring to FIGS. 4, 9, and 11, the luminance of the light emitting diode ED during the driving period DRP of the low frequency frame LF may be the same as the luminance of the normal frame NF illustrated in FIG. 6.

At the start time of each of the first to fourth non-driving periods NDRP1 to NDRP4 of the low frequency frame LF, as the third low voltage VSS3 is changed to 0 V, which is the fourth voltage level V4, and the initialization voltage VINT is changed to −2 V, which is the second voltage level V2, the light emitting diode ED may be initialized. In detail, since the current supplied to the anode of the light emitting diode ED is discharged to the third voltage line VL3 through the third transistor T3, the anode of the light emitting diode ED is initialized. The current supplied through the first voltage line VL1 is transferred to the anode of the light emitting diode ED through the first transistor T1, and the luminance of the light emitting diode ED may gradually increase until a sufficient current corresponding to the data signal Di flows to the light emitting diode ED.

As a result, the change in luminance of each of the first to fourth non-driving periods NDRP1 to NDRP4 illustrated in FIG. 11 may be the same as the change in luminance of the normal frame illustrated in FIG. 6. Therefore, even though the operation mode of the display device DD is changed between the normal mode and the low frequency mode, the change in luminance depending on the operation mode does not occur.

According to an embodiment of the present disclosure, the display device having such a configuration may periodically reset a light emitting diode during the non-driving period of the low frequency mode. As a result, the light emitting luminance of the light emitting diode in the low frequency mode may be similar to the light emitting luminance in the normal mode. Therefore, even though the display device operates in a frequency variable mode that alternates between the normal mode and the low frequency mode, it is possible to prevent the user from recognizing a change in luminance of the display device.

While the present disclosure has been described with reference to embodiments thereof, it will be apparent to those of ordinary skill in the art that various changes and modifications may be made thereto without departing from the spirit and scope of the present disclosure as set forth in the following claims.

What is claimed is:

1. A pixel comprising:

a first transistor including a first electrode which receives a first driving voltage, a second electrode, and a gate electrode;

a second transistor including a first electrode which receives a data signal, a second electrode connected to the gate electrode of the first transistor, and a gate electrode which receives a first scan signal;

a third transistor including a first electrode connected to an initialization voltage line, a second electrode connected to the second electrode of the first transistor, and a gate electrode which receives a second scan signal;

a capacitor connected between the gate electrode and the second electrode of the first transistor; and a light emitting diode including a first terminal connected to the second electrode of the first transistor and a second terminal which receives a second driving voltage, and wherein, during a non-emission period of a low frequency mode, the third transistor electrically connects the first terminal of the light emitting diode to the initialization voltage line in response to the second scan signal, and wherein an initialization voltage transferred from the initialization voltage line has a first voltage level during a normal mode different from the low frequency mode, and has a second voltage level different from the first voltage level during the non-emission period of the low frequency mode.

2. The pixel of claim 1, wherein the second scan signal swings between a high voltage and a low voltage during the normal mode, and wherein the second scan signal has an intermediate voltage between the high voltage and the low voltage during the non-emission period of the low frequency mode.

3. The pixel of claim 2, wherein, when the second scan signal has the intermediate voltage, the third transistor electrically connects the first terminal of the light emitting diode to the initialization voltage line.

4. The pixel of claim 2, wherein the second voltage level of the initialization voltage is less than the first voltage level.

5. The pixel of claim 4, wherein the intermediate voltage of the second scan signal is greater than the second voltage level of the initialization voltage.

6. The pixel of claim 1, wherein each of the first transistor, the second transistor, and the third transistor is an N-type transistor.

7. A display device comprising:

a pixel;

a voltage generator which provides an initialization voltage of a first voltage level to the pixel and generates a low voltage of a third voltage level;

a scan driving circuit which provides a first scan signal and a second scan signal to the pixel, wherein the first scan signal and the second scan signal swing between a high level voltage and a low level voltage;

a data driving circuit which outputs a data signal to the pixel; and a driving controller which controls the scan driving circuit, the data driving circuit, and the voltage generator, and wherein the voltage generator changes the initialization voltage to a second voltage level different from the first voltage level during a non-emission period of a low frequency mode, and changes the low voltage to a fourth voltage level different from the third voltage level.

8. The display device of claim 7, wherein an operation mode of the display device includes a normal mode operating at a first driving frequency and the low frequency mode operating at a second driving frequency lower than the first driving frequency, wherein a low frequency frame of the low frequency mode includes a driving period and at least one non-driving period, and wherein the non-emission period is a part of the non-driving period.

9. The display device of claim 8, wherein the driving controller outputs a voltage control signal corresponding to the operation mode, and wherein the voltage generator generates the initialization voltage and the low voltage in response to the voltage control signal.

10. The display device of claim 8, wherein, in each of the normal mode and the driving period, the first scan signal and the second scan signal swing between the high level voltage and the low voltage of the third voltage level.

11. The display device of claim 8, wherein, during the non-emission period of the non-driving period, the first scan signal and the second scan signal are maintained at the low voltage of the fourth voltage level, and wherein, during the non-driving period except for the non-emission period, the first scan signal and the second scan signal are maintained at the low voltage of the third voltage level.

12. The display device of claim 7, wherein the pixel includes:

a first transistor including a first electrode which receives a first driving voltage, a second electrode, and a gate electrode;

a second transistor including a first electrode which receives the data signal, a second electrode connected to the gate electrode of the first transistor, and a gate electrode which receives the first scan signal;

a third transistor including a first electrode which receives the initialization voltage, a second electrode connected to the second electrode of the first transistor, and a gate electrode which receives the second scan signal;

a capacitor connected between the gate electrode and the second electrode of the first transistor; and a light emitting diode including a first terminal connected to the second electrode of the first transistor and a second terminal which receives a second driving voltage.

13. The display device of claim 12, wherein each of the first transistor, the second transistor, and the third transistor is an N-type transistor.

14. The display device of claim 13, wherein the fourth voltage level of the low voltage is greater than the second voltage level of the initialization voltage.

15. The display device of claim 13, wherein the voltage generator further generates the first driving voltage and the second driving voltage.

* * * * *